US005503455A

United States Patent [19]

Yang

[11] Patent Number: 5,503,455

[45] Date of Patent: Apr. 2, 1996

[54] BACK CUSHION WITH OPTIONALLY ADJUSTABLE INCLINATION

[75] Inventor: Ming-Shun Yang, Taipei, Taiwan

[73] Assignee: Formosa Saint Jose Corp., Taipei, Taiwan

[21] Appl. No.: 251,379

[22] Filed: May 31, 1994

[51] Int. Cl.[6] ..... A47C 31/02

[52] U.S. Cl. ..... 297/377; 297/452.64; 297/440.11

[58] Field of Search ..... 297/377, 452.64, 297/452.63, 452.56, 440.11; 5/420

[56] References Cited

U.S. PATENT DOCUMENTS

| | | | |
|---|---|---|---|
| 1,263,717 | 4/1918 | Stone | 297/440.11 X |
| 2,156,664 | 5/1939 | Litle, Jr. | 297/452.63 X |
| 2,368,498 | 1/1945 | Sturgeon | 297/377 X |
| 3,197,789 | 8/1965 | Ashkouti et al. . | |
| 3,342,294 | 9/1967 | Beatty | 297/377 X |
| 3,843,477 | 10/1974 | Rowland | 297/452.64 X |
| 4,137,583 | 2/1979 | Baldwin et al. | 5/420 |
| 4,510,634 | 4/1985 | Diedrich et al. | 297/440.11 X |
| 5,127,707 | 7/1992 | Forcolini | 297/440.11 X |
| 5,398,993 | 3/1995 | Chen | 297/452.64 X |

*Primary Examiner*—Peter M. Cuomo
*Assistant Examiner*—David E. Allred
*Attorney, Agent, or Firm*—Young & Forward

[57] ABSTRACT

A person can be supported in a reclining position on a support device that includes a back cushion defined by an annular curved frame, and a beaded cushion panel anchored to the frame. The back cushion is connected to a seat cushion and a supporting stand by a cable system having terminal end areas tied together at selected points by a cable clamp mechanism. The cable clamp mechanism can be moved along mating areas of the cable to swing the lower end of the stand toward or away from the lower edge of the back cushion. The inclination angle of the back cushion can be adjusted, or varied, by changing the position of the clamp mechanism on the cable.

3 Claims, 7 Drawing Sheets

BACK CUSHION WITH OPTIONALLY ADJUSTABLE INCLINATION

BACKGROUND OF THE INVENTION

Recliner chairs are available that enable a person to assume a reclining position while reading a newspaper, watching the television or taking a nap. However, after the person has reclined in the chair for a period of time he may experience symptoms of lumbago, back pain, head discomfort or neck discomfort, due to the fact that many recliner chairs do not conform closely to contours of the human back vertebrae. Also, conventional recliner chairs are often not adjustable as regards the inclinaton angle of the back cushion; consequently the person may feel some discomfort after sitting in the chair for a long period of time.

The present invention concerns a device for supporting a person in a reclining position, so that the person's back vertebrae are adequately supported, whereby the person remains comfortable, even after extended periods of time. The device includes an adjustment for the inclination angle of the back cushion, whereby the person can set the device in a range of different inclination angles.

SUMMARY OF THE INVENTION

The support device of the present invention comprises a seat cushion, back cushion, a stand (or brace) for supporting said back cushion in an inclined upright position, and a cable system for swinging the lower end of the stand toward or away from the back cushion, to adjust the inclination angle of the back cushion. The back cushion is preferably comprised of an annular, generally rectangular frame having a front surface curvature conforming approximately to the curvature of the human back vertebrae, and a beaded cushion mounted in said frame to form a cushion surface.

DETAILED DESPRIPTION OF A PREFERRED EMBODIMENT OF THE INVENTION

Figure 1:
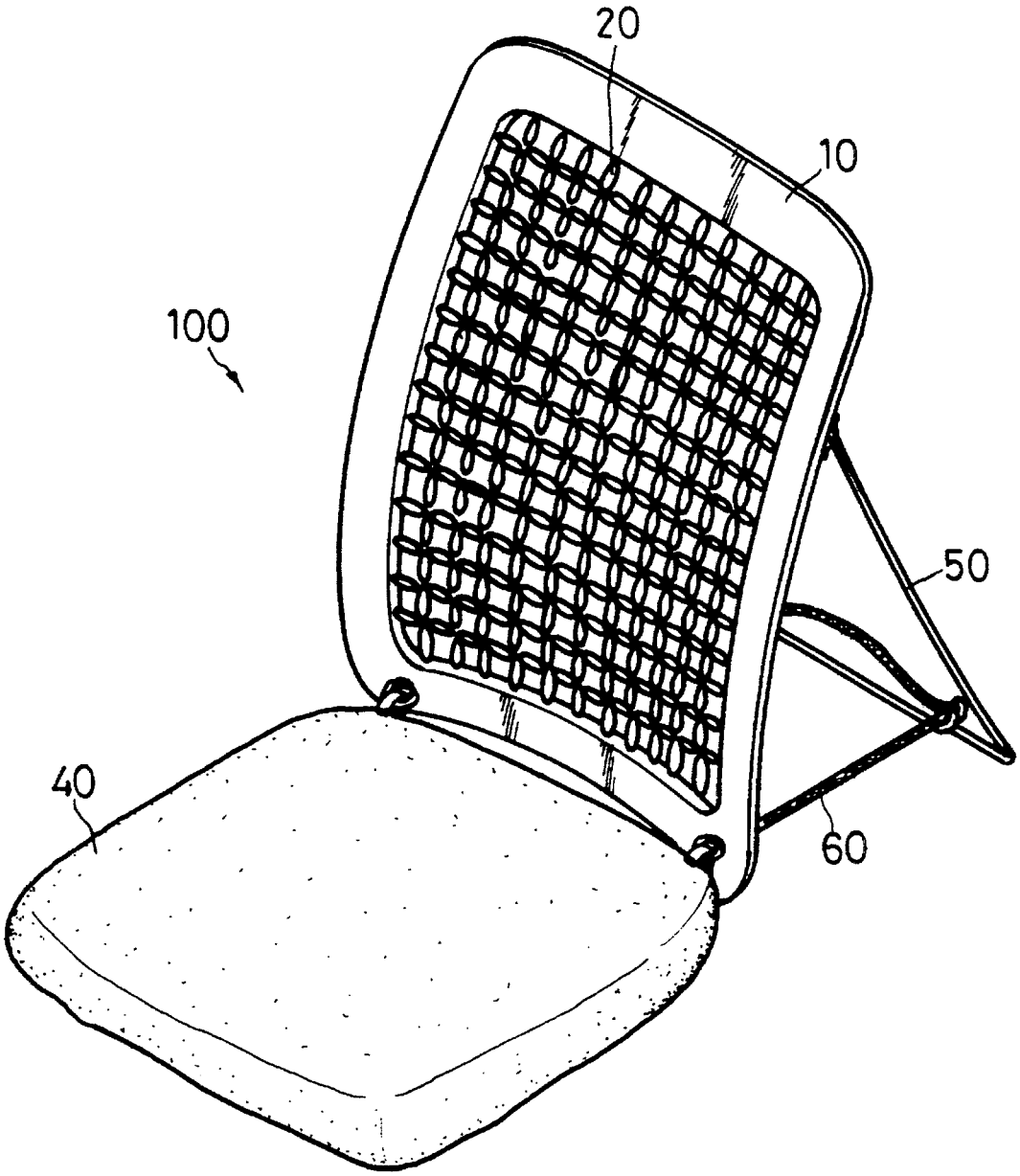
FIG. 1 is an elevational perspective view of a human support device constructed according to the present invention.
Figure 2:
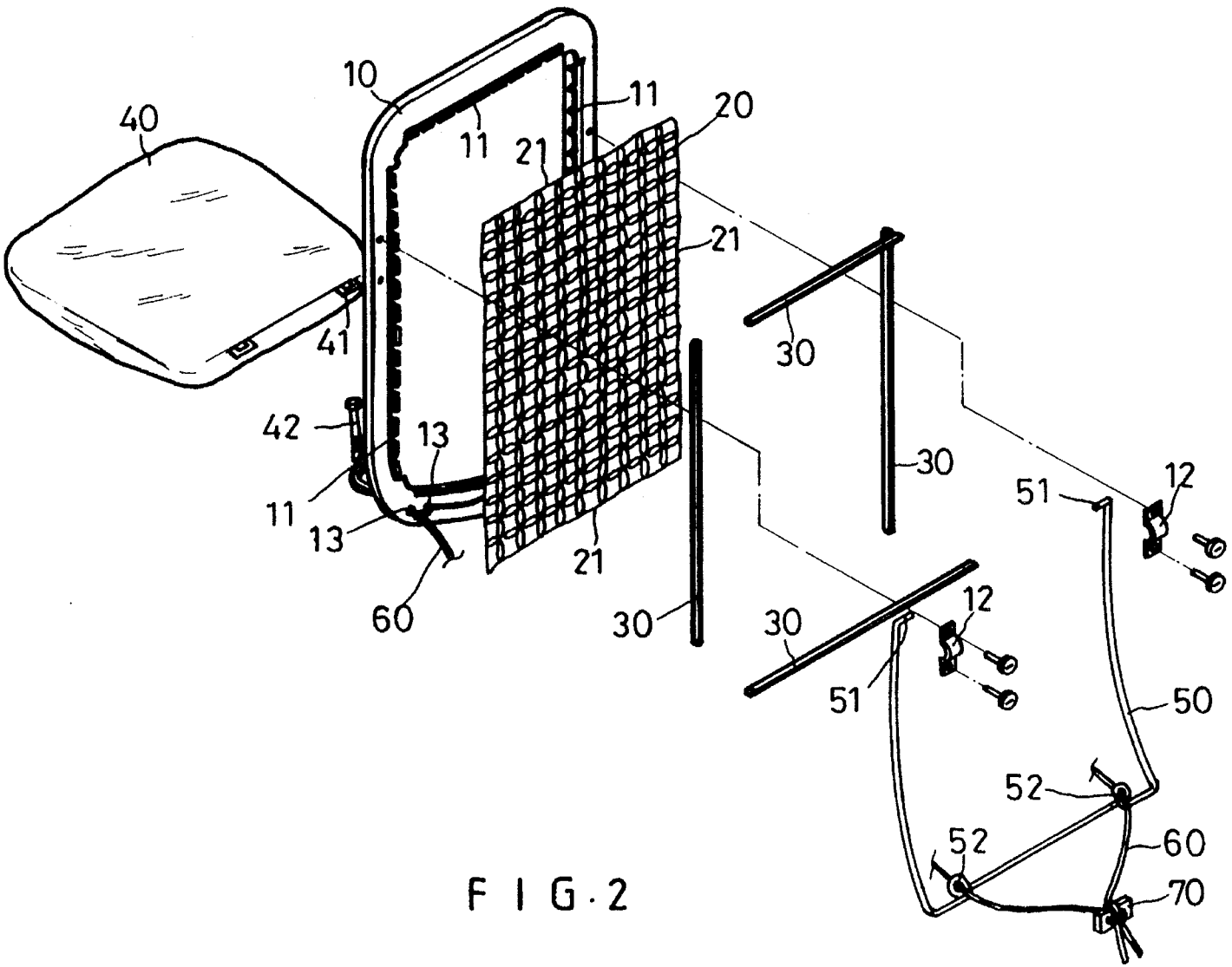
FIG. 2 is an exploded view of certain components used in the device depicted in FIG. 1.

As shown in FIG. 1 and 2, the human support device 100 of the present invention comprises a back cushion that includes a curved frame (10), a beaded cushion panel (20) four locking strips (30), a seat cushion (40), a stand or brace (50), a cable (60), and a cable clamping means (70). The curved frame (10) forms a curve coinciding with the human body to fully contact the human back, waist and neck vertebrae when the network beaded cushion (20) and the curved frame (10) are assembled with and fixed onto each other to form a back cushion. The beads are spaced slight distances apart to provide a ventilated back cushion that fits comfortably against the person's back and neck.

Figure 3:
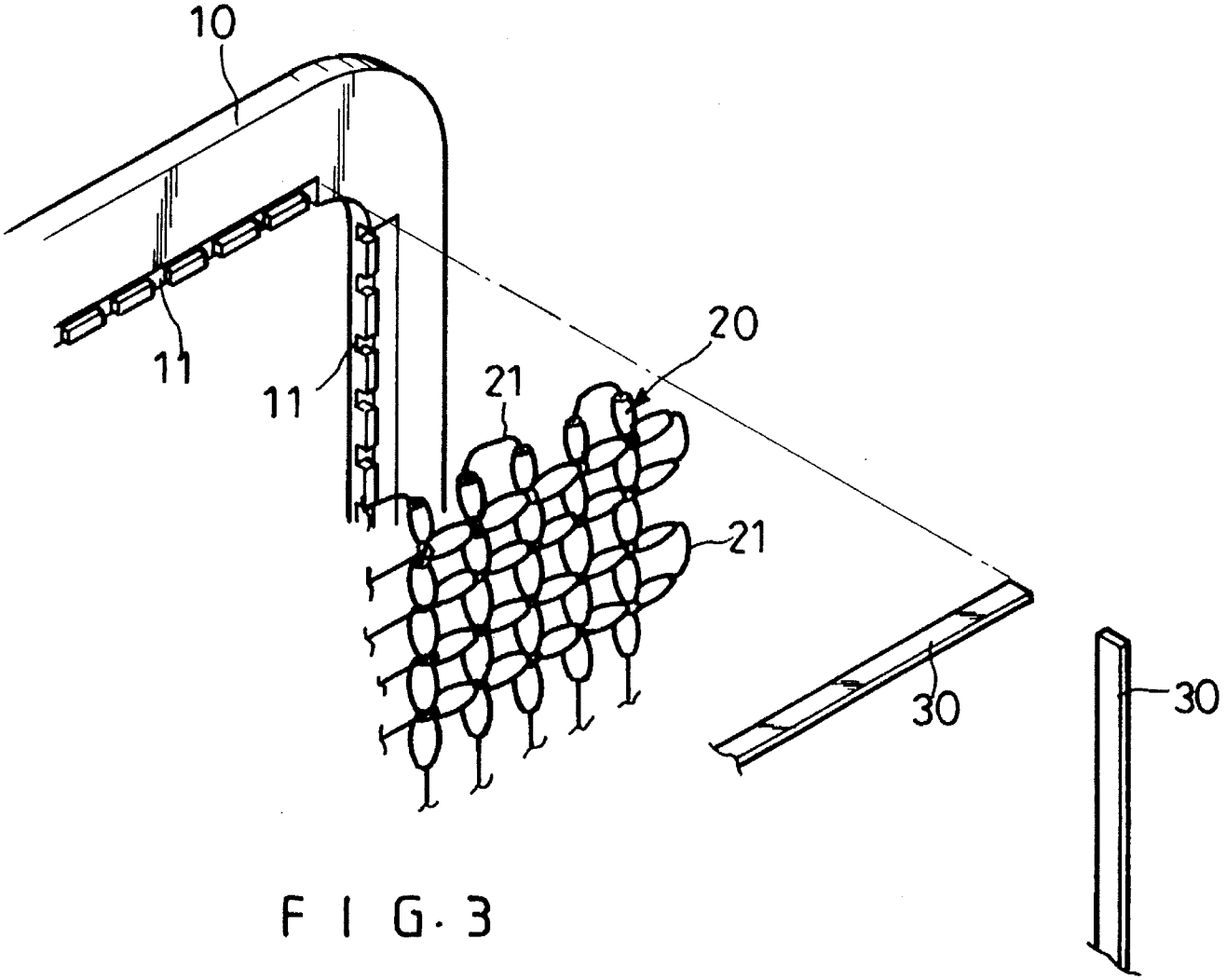
FIG. 3 is a fragmentary view of a frame-beaded cushion assembly used in the FIG. 1 device.
Figure 5:
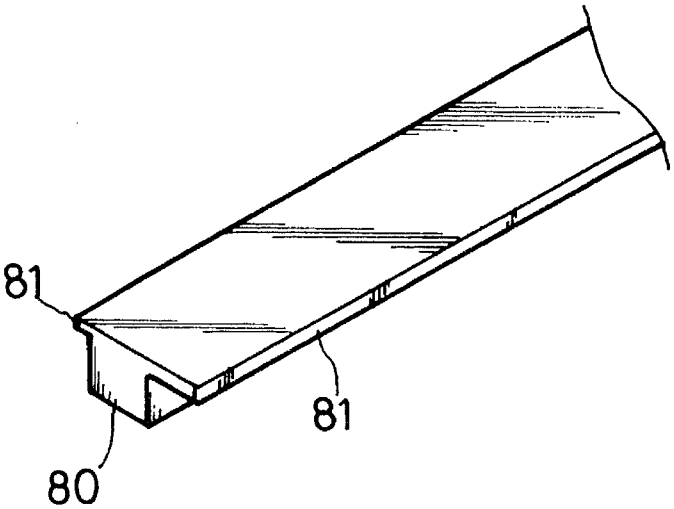
FIG. 5 is a fragmentary perspective view of a locking strip that can be used in practice of the present invention.
Figure 6:
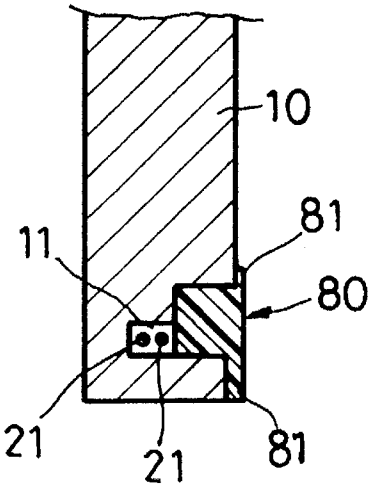
FIG. 6 is a view taken in the same direction as FIG. 4, but showing an alternate locking strip that can be used in practice of the invention.
Figure 4:
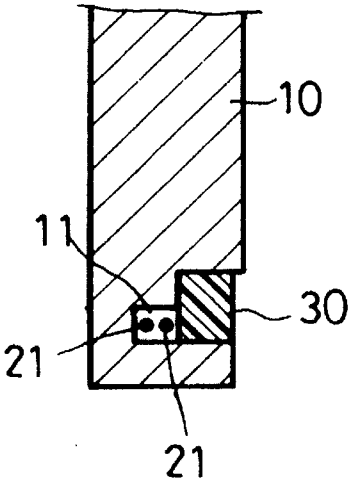
FIG. 4 is a transverse sectional view taken through a frame and locking strip used in the FIG. 1, device.

As shown in FIG. 2, 3 and 4, a plurality of continuous cord anchorage grooves (11) are provided along the back surface of the curved annular frame (10) to anchor the individual nylon cord loops (21) formed on the periphery of the beaded cushion panel (20). After the beaded cushion (20) is wholly inserted into the curved frame (10), the four locking strips (30) can be inserted into the cord anchorage grooves (11) so as to integrate the beaded cushion panel (20) with the curved frame (10) as one body. Each groove (11) comprises a channel and a plurality of notches communicating with the channel, so that each loop of the cord fits into two notches and the connecting portion of the channel. As shown in FIG. 5 and 6, an alternate locking strip (80) has flanges (81) engageable with the rear face of frame (10) to form an ornamental border on frame (10). One of the flanges overlies the notches of the groove (11) to conceal the cord loops.

Referring to FIG. 1, two cable anchorage holes (41) are provided at the rear edge of seat cushion (40). When the seat cushion (40) has its rear edge located proximate to the lower edge of the curved frame (10), the holes (41) on the seat cushion (40) are adapted to be connected to the cable (60) extending through guide openings (13) in frame (10) by retaining clamps (42). Two retaining clamps (42) can be extended through the openings (41) and the cable loops so that seat cushion (40) is attached to back cushion (10,20). The seat cushion (40) will never move rearward even under the effect of gravitation from the user reclining on the back cushion.

Figure 9:
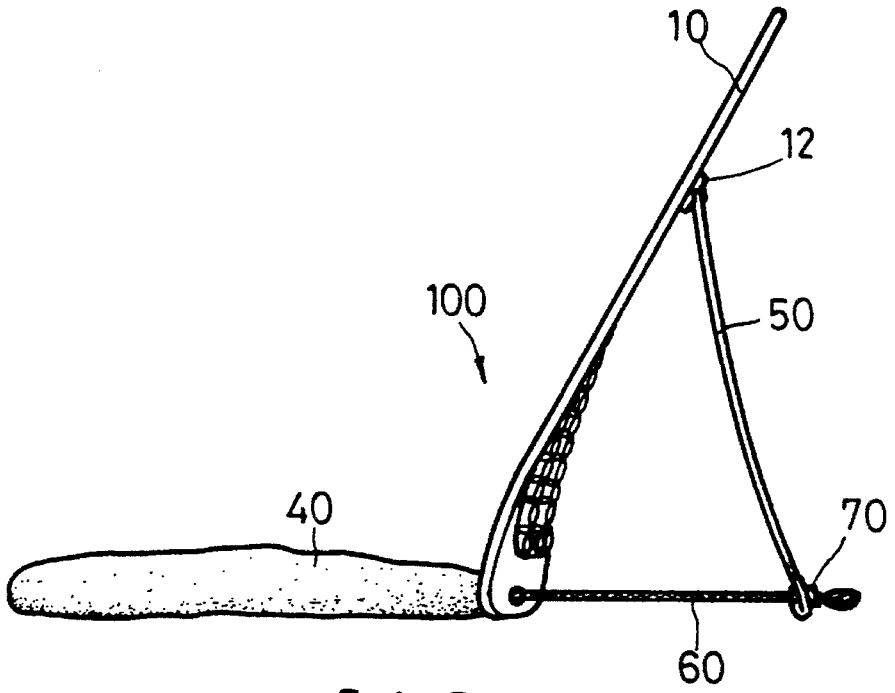
FIGS. 9 and 10 are side views of a back cushion of the present invention, showing the cushion in two different inclination angles.
Figure 10:
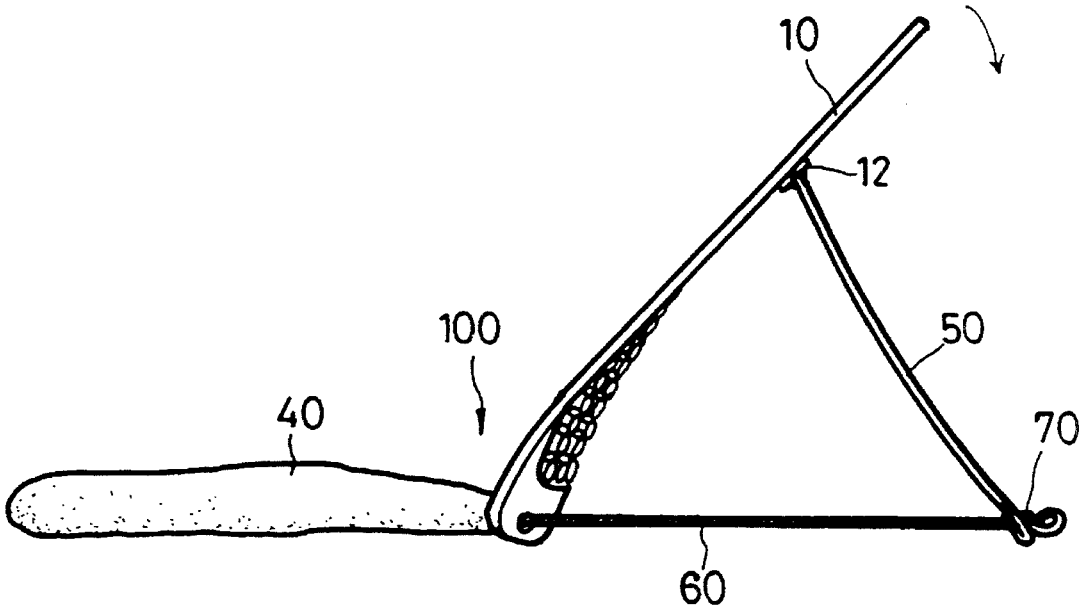

As shown in FIG. 2, two hinge brackets (12) are provided on the left and right sides of frame (10) to pivotably receive two ears (51) at the upper ends of the supporting stand (50). The stand is therefore able to freely swing on the rear face of the curved frame (10), so that a suitable inclination of the back cushion can be obtained, as shown in FIGS. 9 and 10. The user can feel comfortable while reclining on the back cushion. Stand (50) has two spaced holes (52) at the lower edge designed to accomodate sections of the cable (60), so that terminal end areas of the cable (60) can be clamped or tied together, e.g. by the clamp assembly shown in FIGS. 7 and 8, or the clamp assembly shown in FIGS. 11 and 12. By moving the clamp assembly shown along the cable sections, it is possible to adjust the inclination angle of the back cushion, as shown in FIGS. 9 and 10.

Figure 8:
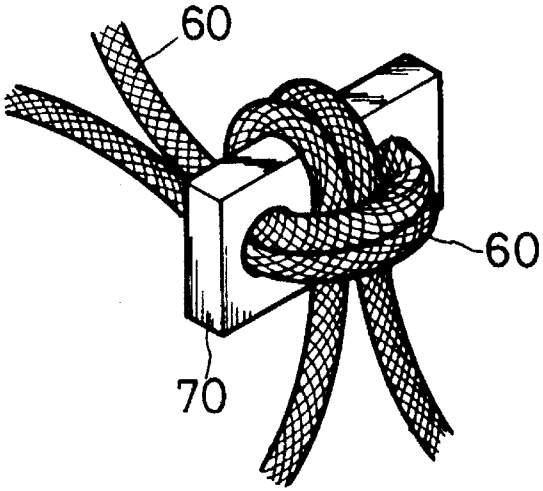
FIGS. 7 and 8 are views of a cable clamp means that can be used in practice of the present invention.
Figure 7:
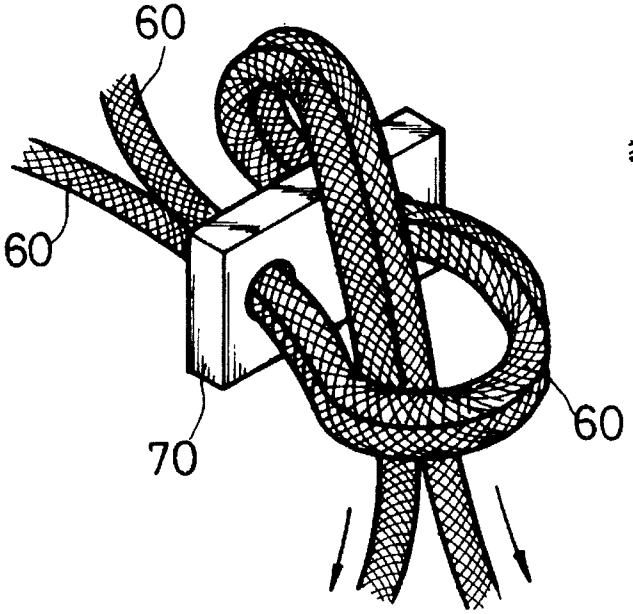

As shown in FIG. 2 and 7, after going through the through openings (13) at the lower edge of curved frame (10) and the cable guide holes (52) at the lower edge of supporting stand (50), the end areas of the cable (60) can be tied and fixed by means of the clamping block (70) as shown in FIG. 8. When the user has adjusted the required length of cable (60) to set the inclination of the back cushion, he can comfortably recline on the back cushion.

Figure 12:
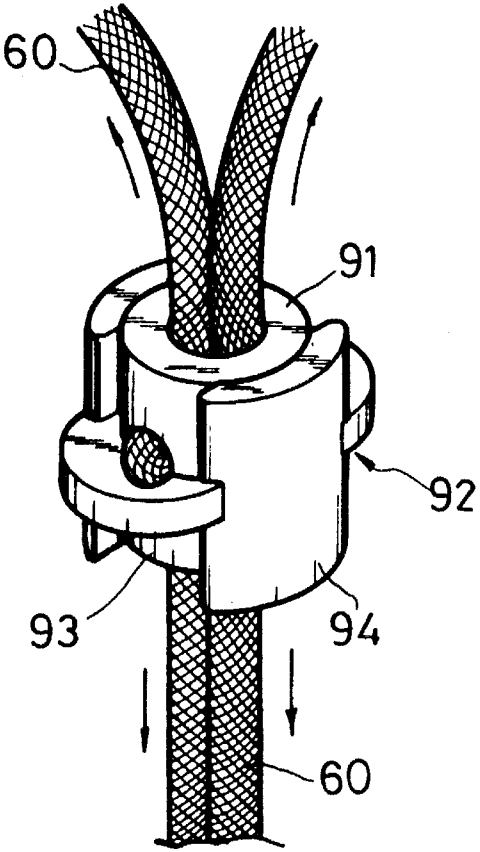
FIG. 12 is a perspective view of the cable clamping device of FIG. 11 installed on a cable according to the present invention.
Figure 11:
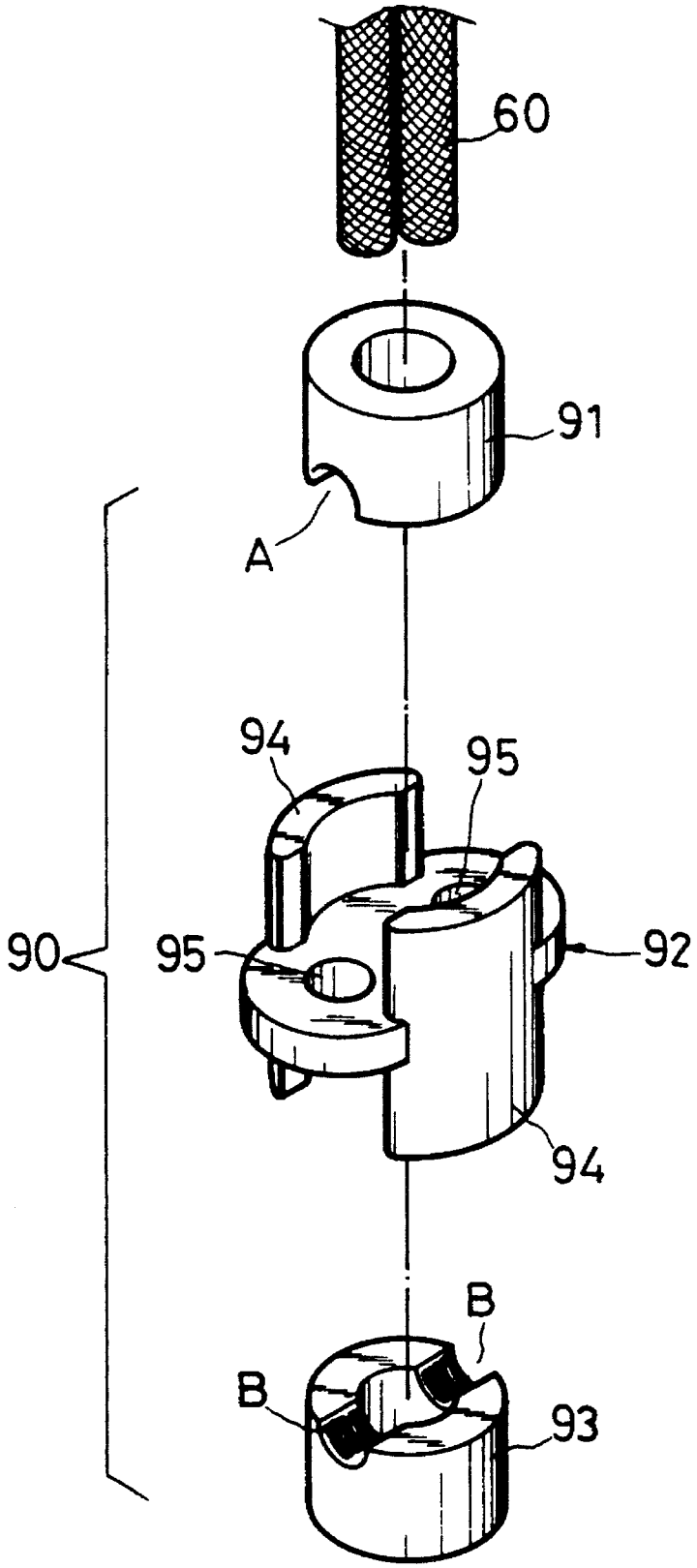
FIG. 11 is an exploded perspective view of a cable clamping device.

As shown in FIG. 11 and 12, end areas of of the cable (60) can be clamped through a binding (or clamping) assembly (90) that includes an upper annular retainer (91), a central hollow binding element (92), and a lower annular retainer (93). The upper and lower retainers (91) and (93) are respectively provided with semi-circular recesses A and B corresponding to each other. Two arcuate walls (94) on the central binding element (92) can fit around the upper and lower retainers (91) and (93). Two parallel through holes (95) are provided on the main wall of binding element (92), to communicate with the two semi-circular recesses A and B when the retainer elements (91) and (93) are slid into the sockets formed by arcuate walls (94).

Therefore, the sections of cable (60) within holes 95 can be firmly bound through the binding force of upper and lower retainers (91) and (93).

In view the above, it will be seen that the support device according to the present invention is characterized in the following advantages:

1. The back cushion has a curve to conform with the human body, especially the vertebrae of of the human back, waist and neck, so that the user feels very comfortable.

2. Since there is a movable pivotable relation between stand (50) and the curved frame, the effective length of cable (60) can be optionally adjusted and controlled, so there are countless angles of inclination for the person's individual choice; to wit, the user can optionally set the back cushion at his own satisfactory and comfortable reclining angles.

3. The assembly or operational usage of the present support device is very simple and convenient. The device can be readily stored in a very small storage space for usage whenever needed.

I claim:

1. A device for partially supporting a person in a reclining position comprising:

a seat cushion; a back cushion; a stand for supporting said back cushion in an inclined upright position; and a cable means interconnecting said seat cushion, back cushion and stand, whereby said stand serves as a support for the back cushion;

said seat cushion having a rear edge and two spaced cable anchorage holes proximate to said rear edge;

said back cushion comprising an annular curved frame having a left side edge, a rear side edge, an upper edge, and a lower edge; said frame having a front face, and a rear face; cord anchorage groove means in the rear face of said frame; criss-crossing cords having anchoring loops in said groove means; beads strung on said criss-crossing cords to form a beaded cushion surface; and locking strips in said groove means overlying the anchoring loops;

said stand having pivotal connections with the rear face of said frame so that the stand can swing around said pivotal connections to adjust the inclination angle of said back cushion;

said frame having two openings proximate to said frame lower edge in registry with the aforementioned cable anchorage holes in said seat cushion;

said stand having two cable guide holes aligned with the openings in said frame;

said cable means comrising a flexible cable having duplicate cable sections extendable from the cable anchorage holes in said seat cushion through said frame openings and cable guide holes; said duplicate cable sections having matable terminal end areas; and a cable clamp means positionable at selected points along the cable end areas to vary the distance between said frame openings and said cable guide holes, to thereby adjust the inclination angle of the back cushion.

2. The device of claim 1, wherein said cord anchorage groove means comprises a channel in the rear face of said frame, and a plurality of notches communicating with said channel so that each anchoring loop extends through two notches and a portion of said channel; said locking strips extending within said channels; each locking strip having a flange overlying the notches associated with the respective channel.

3. The device of claim 1, wherein said cable clamp means comprises a three piece assembly that includes a central hollow binding element having two passages for the cable sections, a first annular retainer slidable on the cable sections into said hollow binding element in one direction, and a second annular retainer slidable on the cable sections into said hollow binding element in the other direction.

* * * * *